US007614882B2

(12) United States Patent
Koguchi et al.

(10) Patent No.: US 7,614,882 B2
(45) Date of Patent: Nov. 10, 2009

(54) ELECTRICAL CONNECTOR

(75) Inventors: Mitsuo Koguchi, Tokyo (JP); Takuya Takahashi, Tokyo (JP); Hiroshi Akimoto, Tokyo (JP); Seiya Takahashi, Tokyo (JP); Yoshiaki Ishiyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/231,644

(22) Filed: Sep. 4, 2008

(65) Prior Publication Data

US 2009/0075498 A1 Mar. 19, 2009

(30) Foreign Application Priority Data

Sep. 14, 2007 (JP) ..... 2007-240173

(51) Int. Cl.
*H01R 12/00* (2006.01)

(52) U.S. Cl. ..... 439/65; 439/74

(58) Field of Classification Search ..... 439/65, 439/55, 68, 74; 361/803
See application file for complete search history.

(56) References Cited

U.S. PATENT DOCUMENTS 7,435,098 B2 * 10/2008 Yi et al. ..... 439/65
2005/0221632 A1 * 10/2005 Sun et al. ..... 439/65
2007/0117417 A1 * 5/2007 O'Brien ..... 439/65
2008/0057744 A1 * 3/2008 Moritake ..... 439/65

FOREIGN PATENT DOCUMENTS

| | | |
|---|---|---|
| JP | 59-181478 | 10/1984 |
| JP | 62-163981 | 10/1987 |
| JP | 01-019833 | 1/1989 |
| JP | 3-241677 | 10/1991 |
| JP | 5-075248 | 3/1993 |

OTHER PUBLICATIONS

Japanese Office Action dated Jul. 9, 2009 with English translation of same.

* cited by examiner

*Primary Examiner*—Hien Vu
(74) *Attorney, Agent, or Firm*—Collard & Roe, P.C.

(57) ABSTRACT

An electrical connector is disclosed. Connection targets have edges, respectively, on which conductive portions are formed. The electrical connector serves to electrically connect the conductive portions of connection targets with the edges facing each other. The electrical connector comprises an electrode sheet, a press member and a connection keeper. The electrode sheet comprises an insulation sheet and an electrode pattern formed on the insulation sheet. The press member is made of elastic material distinct from the electrode sheet. The press member is arranged to press the electrode pattern against the conductive portions of the connection targets when the press member is compressed, so that the conductive portions of the connection targets are connected to each other by the electrode pattern. The connection keeper is configured to keep the connection between the conductive portions of the connection targets with the press member compressed.

7 Claims, 10 Drawing Sheets

ELECTRICAL CONNECTOR

CROSS REFERENCE TO RELATED APPLICATIONS

Applicants claim priority under 35 U.S.C. §119 of Japanese Application No. 2007-240173 filed Sep. 14, 2007.

BACKGROUND OF THE INVENTION

This invention relates to an electrical connector for electrically connecting conductive portions formed on edges of plate-like or sheet-like connection targets, respectively, while the edges face each other. For example, the plate-like connection target is a printed circuit board, and the sheet-like connection target is a flexible flat cable.

JP-Y H01-19833 discloses an electrical connector which comprises a connection member for electrically connecting flexible flat cables with each other. The connection member is comprised of a silicone rubber sheet and a conductive portion directly formed on the silicone rubber sheet. However, the disclosed connector cannot connect rigid circuit boards to each other. In addition, the disclosed connector has a problem that the conductive portion is easily breakable when the silicone rubber sheet is applied by a shearing stress.

SUMMARY OF THE INVENTION

It is an object of the present invention to provide an electrical connector which can also connect circuit boards and which is tolerant to a shearing stress.

One aspect of the present invention provides an electrical connector for electrically connecting connection targets such as plate-like targets or sheet-like targets. The connection targets have edges, respectively, on which conductive portions are formed. The electrical connector serves to electrically connect the conductive portions of connection targets with the edges facing each other. The electrical connector comprises an electrode sheet, a press member and a connection keeper. The electrode sheet comprises an insulation sheet and an electrode pattern formed on the insulation sheet. The press member is made of elastic material distinct from the electrode sheet. The press member is arranged to press the electrode pattern against the conductive portions of the connection targets when the press member is compressed, so that the conductive portions of the connection targets are connected to each other by the electrode pattern. The connection keeper is configured to keep the connection between the conductive portions of the connection targets with the press member compressed.

An appreciation of the objectives of the present invention and a more complete understanding of its structure may be had by studying the following description of the preferred embodiment and by referring to the accompanying drawings.

Figure 1:
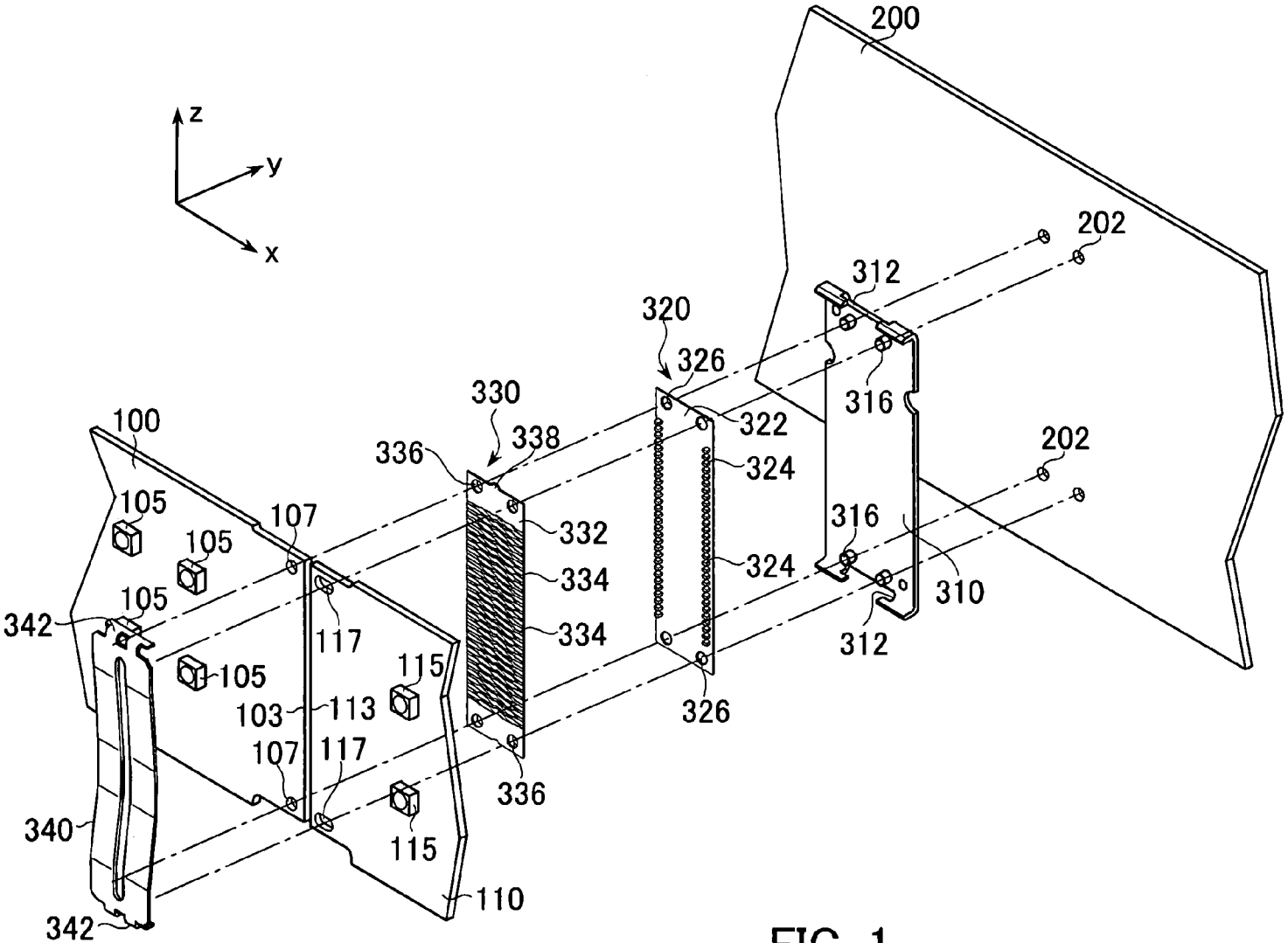
FIG. 1 is an exploded, perspective view showing an electrical connector in accordance with an embodiment of the present invention, wherein a part of a case and circuit boards are also shown.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

With reference to FIG. 1, an electrical connector according to an embodiment of the present invention is used to electrically connect two circuit boards 100, 110. Namely, the circuit boards 100, 110 are connection targets in this embodiment. Each of the circuit boards 100, 110 is provided with a conductive portion that is formed on an edge 103, 113 of the circuit board 100, 110. On each of the circuit boards 100, 110, a plurality of LED (light-emitting diode) elements are mounted. The circuit boards 100, 110 are to be installed in an apparatus that comprises a chassis or case 200.

Figure 2:
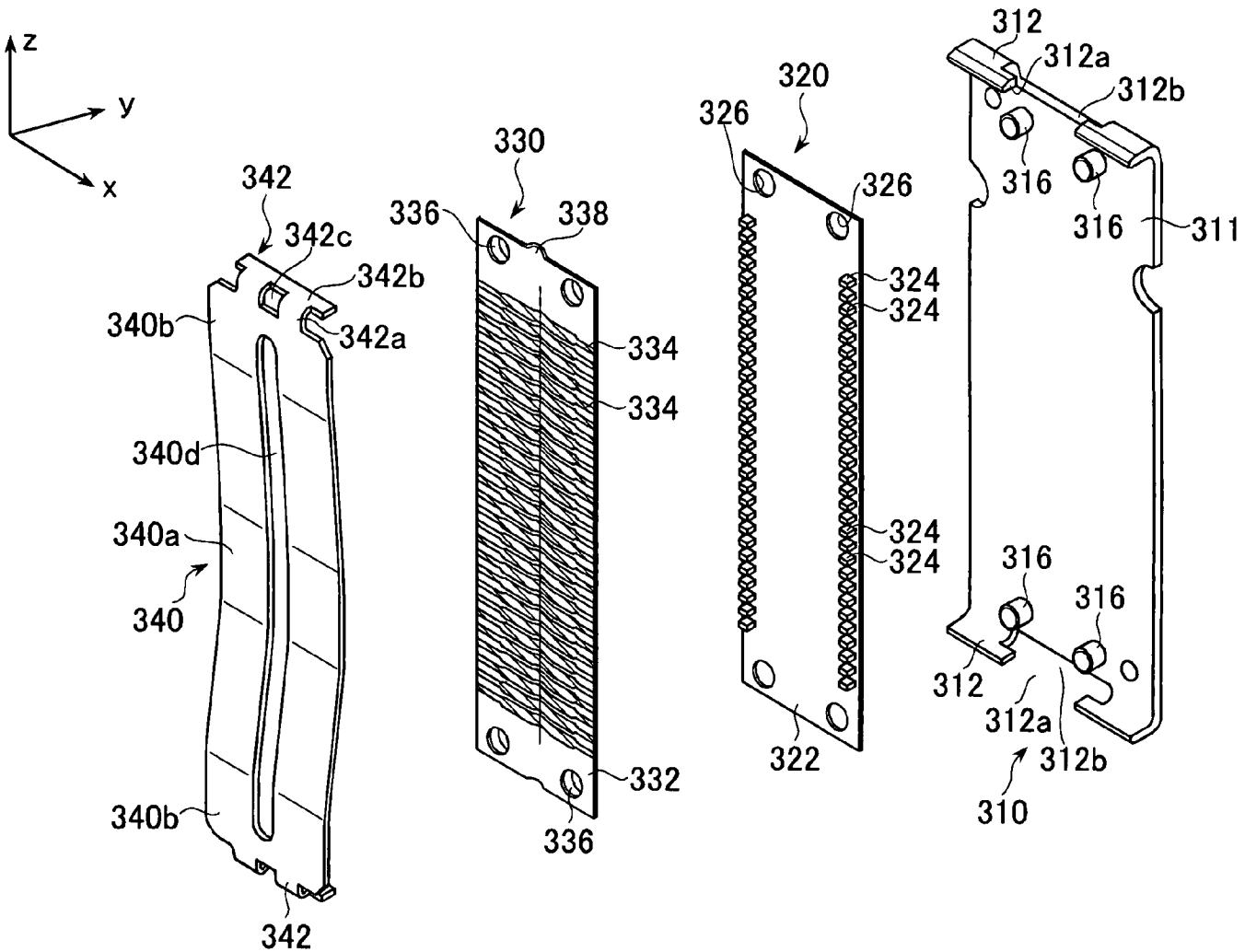
FIG. 2 is another exploded, perspective view showing only the electrical connector of FIG. 1.
Figure 3:
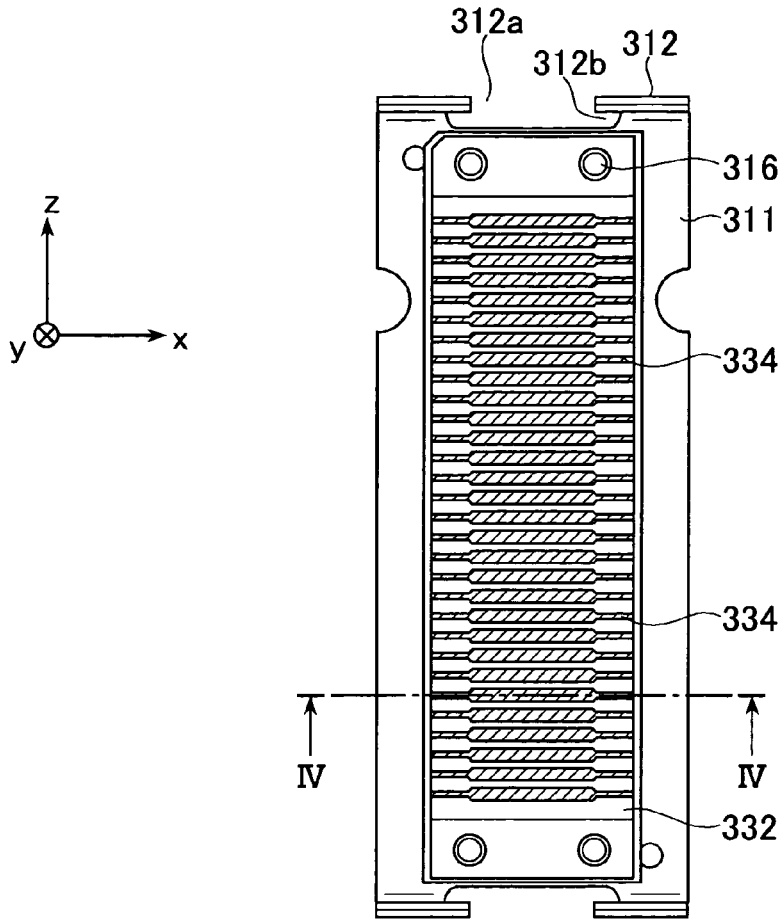
FIG. 3 is a plan view showing the electrical connector of FIG. 1, wherein a lock member is not shown.

With reference to FIGS. 1 and 2, the electrical connector comprises a base plate 310, a press member 320, an electrode sheet 330 and a lock member 340.

The base plate 310 is to be attached to the case 200 and serves as a supporter for supporting the press member 320. The base plate 310 of the present embodiment is made of metal but may be made of other material such as resin.

As shown in FIG. 2, the base plate 310 has a plate-like main portion 311 and first portions 312 formed at opposite ends of the main portion 311 in a longitudinal direction of the main portion 311, i.e. a z-direction. Each of the first portions 312 has a C-like shape, and its ends extend along a y-direction. Each of the first portions 312 is formed with a receiving portion 312*a* and a wider portion 312*b*, wherein the C-like shape opens at the receiving portion 312*a*, and the wider portion 312*b* is wider than the receiving portion 312*a* in an x-direction. In other words, each first portion 312 defines a reverse T-like shaped opening that consists of the receiving portion 312*a* and the wider portion 312*b*.

The base plate 310 of the present embodiment is formed integrally with four positioning protrusions 316. However, the positioning protrusions 316 may be dowels which are distinct from the base plate 310; in that case, the base plate 310 is formed with holes, into which the dowels are inserted, respectively.

Figure 4:
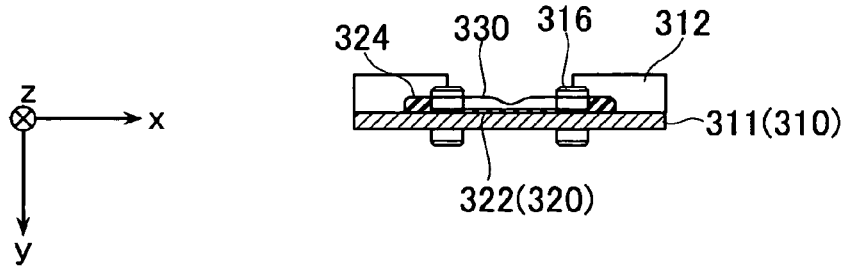
FIG. 4 is a cross-sectional view showing the electrical connector of FIG. 3, taken along lines IV-IV, wherein the lock member is not shown.
Figure 8:
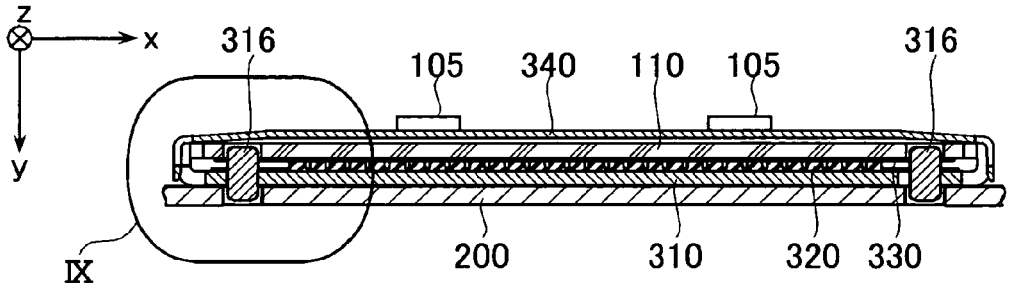
FIG. 8 is a cross-sectional view showing the electrical connector of FIG. 5, taken along lines VIII-VIII.
Figure 9:
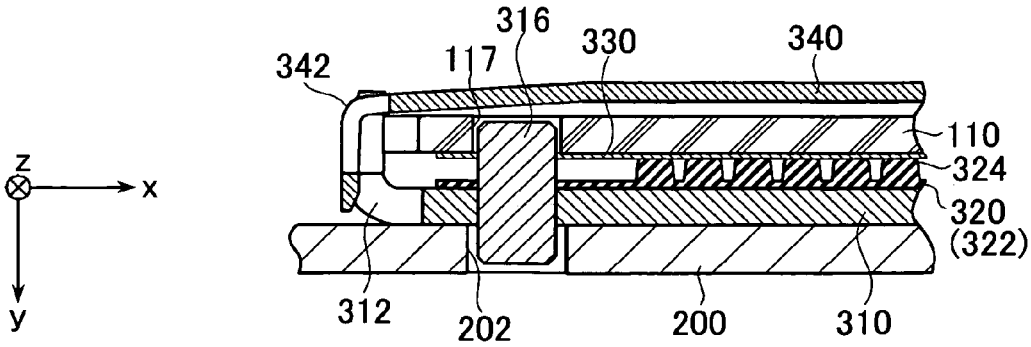
FIG. 9 is an enlarged, cross-sectional view showing the electrical connector of FIG. 8, circled by a line IX.

With reference to FIGS. 4, 8 and 9, each of the positioning protrusions 316 according to the present embodiment protrudes from both surfaces of the main portion 311. The positioning protrusions 316 are inserted into positioning holes 202 of the case 200 so that the base plate 310 is positioned on a predetermined region of the case 200.

The press member 320 of the present embodiment is made of elastic material and insulative material distinct from the electrode sheet 330. In this embodiment, the press member 320 is made of silicone rubber. The press member 320 is not limited to be made of silicone rubber but may be made of other material. It is preferable that the press member 320 is made of material that has a high heat-dissipation function.

With reference to FIGS. 2, 4 and 6 to 9, the press member 320 comprises a main sheet portion 322 and a plurality of protrusions 324 protruding from the main sheet portion 322. The protrusions 324 are deformable independently from each other and respectively correspond to conductive traces formed on the electrode sheet 330, as described in detail afterwards.

With reference to FIG. 2, the illustrated press member 320 is formed with positioning holes 326, into which the positioning protrusions 316 are inserted, respectively, so that the press member 320 is attached to the base plate 310. In this embodiment, a distance between the positioning holes 326 in the x-direction is equal to a distance between the positioning protrusions 316 in the x-direction. Being compressed, the press member 320 provides an elastic force as a reaction force.

With reference to FIG. 2, the electrode sheet 330 comprises an insulation sheet 332 and an electrode pattern 334. The electrode sheet 330 is distinct from the press member 320. The electrode pattern 334 of the present embodiment consists of a plurality of conductive traces each extending in the x-direction. The electrode pattern 334 is formed on a surface of the insulation sheet 332; the back surface of the insulation sheet 332 is brought into contact with the press member 320, specifically, the protrusions 324. When the electrical connector of this embodiment is used, the conductive traces are pressed by the independently-deformable protrusions 324 of the compressed press member 320 onto the conductive portions of the circuit boards 100, 110 to connect the conductive portions to each other.

With reference to FIG. 2, the electrode sheet 330 is formed with four positioning holes 336, into which the positioning protrusions 316 are inserted, respectively, so that the electrode sheet 330 is attached to the base plate 310 with the press member 320 positioned therebetween, as shown in FIGS. 4, 8 and 9. In this embodiment, the positioning holes 326 are arranged so that the electrode sheet 330 has a sag 338 when the positioning protrusions 316 are inserted into the positioning holes 336, respectively. Specifically, the electrode sheet 330 is designed so that a distance between the positioning holes 336 in the x-direction is larger than a distance between the positioning protrusions 316 in the x-direction.

Figure 5:
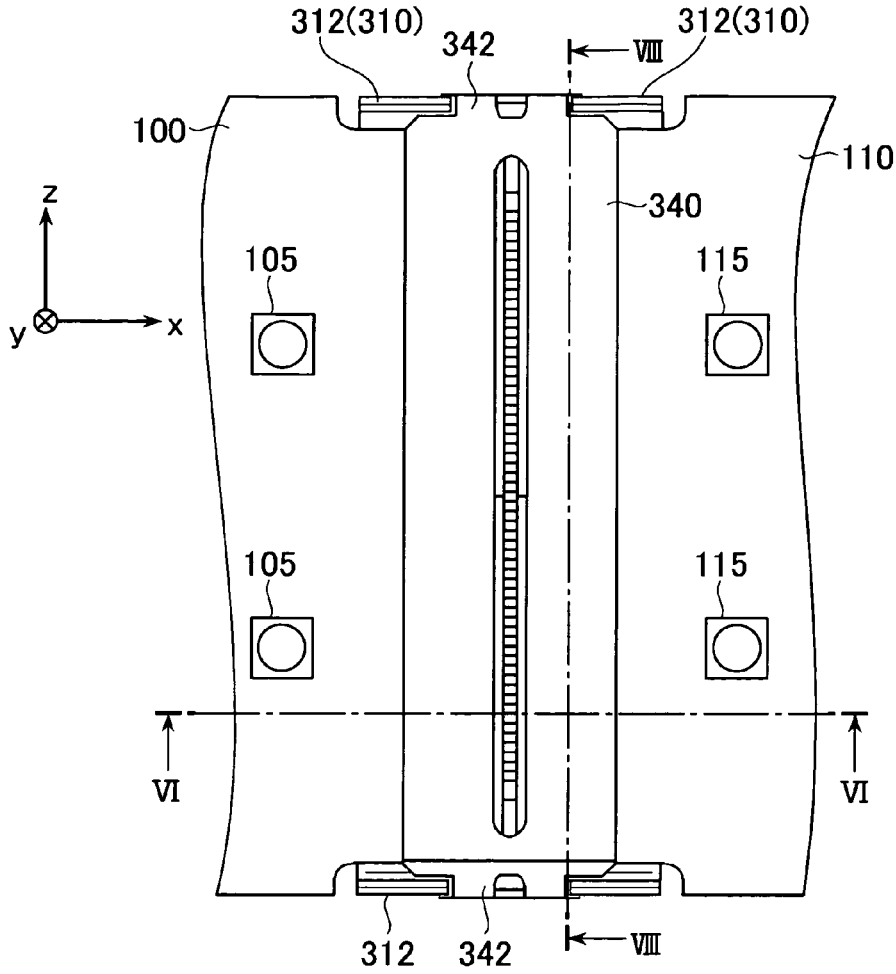
FIG. 5 is a plan view showing the electrical connector of FIG. 1.
Figure 6:
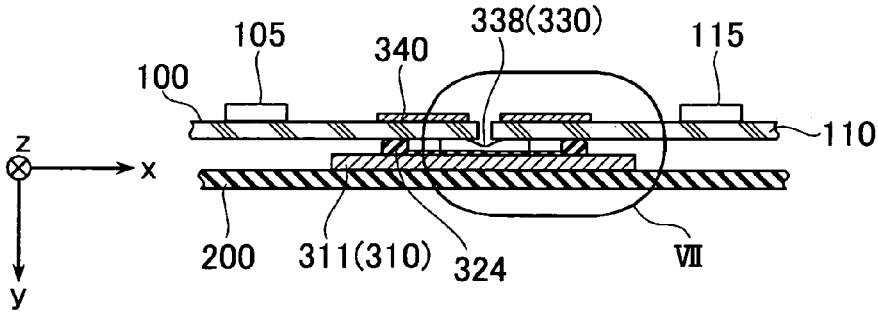
FIG. 6 is a cross-sectional view showing the electrical connector of FIG. 5, taken along lines VI-VI.
Figure 7:
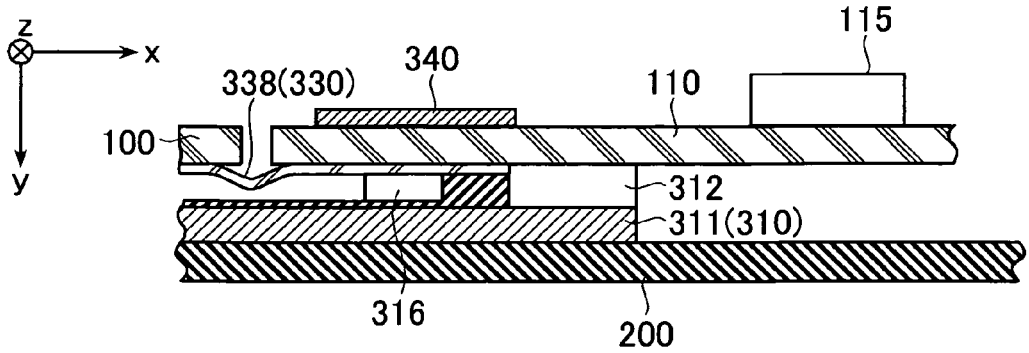
FIG. 7 is an enlarged, cross-sectional view showing the electrical connector of FIG. 6, circled by a line VII.

With reference to FIGS. 2, 5 and 6, the lock member 340 according to the present embodiment and the above-mentioned base plate 310 serve as a connection keeper which is for keeping the connection between the conductive portions of the circuit boards 100, 110 with the press member compressed. In detail, the connection keeper of the present embodiment, i.e. the lock member 340 and the base plate 310, is configured to hold the edges 103,113 of the circuit boards 100, 110 and the press member 320. Under the held state, the electrode sheet 330 is sandwiched between the press member 320 and the edges 103, 113 of the circuit boards 100, 110, and the press member 320 is compressed so that the press member 320 presses the electrode pattern 334 of the electrode sheet 330 against the conductive portions of the circuit boards 100, 110.

The lock member 340 is made of metal but may be made of other material such as resin.

As shown in FIG. 2, the lock member 340 has second portions 342 formed at opposite ends of the lock member 340 in a longitudinal direction of the lock member 340, i.e. the z-direction. The second portions 342 are to be engaged with the first portions 312, respectively. Each of the second portions 342 has a T-like shape, and its end extends along the y-direction. Each of the second portions 342 comprises a neck portion 342*a* and a head portion 342*b*. The head portion 342*b* is larger than the neck portion 342*a* in the x-direction. In detail, the neck portion 342*a* is smaller than the receiving portion 312*a* in the x-direction, while the head portion 342*b* is larger than the receiving portion 312*a* in the x-direction. As apparent from FIG. 2, the lock member 340 has a M-like shape in a cross-section on a yz-plane when the second portions 342 are not engaged with the first portions 312. The M-shaped lock member 340 can provide a pressure to compress the press member 320 in the y-direction when the second portions 342 are engaged with the first portions 312.

In detail, the lock member 340 is provided with a first flat portion 340*a*, second flat portions 340*b*, holes 342*c* and a slit 340*d*. The first flat portion 340*a* is positioned at a center of the lock member 340 in the z-direction and is perpendicular to the y-direction. The second flat portions 340*b* are parallel with the first flat portion 340*a* and are positioned at the vicinity of the opposite ends of the lock member 340 in the z-direction. From edges of the second flat portions 340*b*, the respective second portions 342 are curved and extend along the y-direction. The holes 342*c* are formed in the neck portions 342, respectively. The slit 340*d* extends along the z-direction. Because the slit 340*d* functionally separates the lock member 340 into two parts in the x-direction, the lock member 340 is tolerant of a small difference between thicknesses of the circuit boards 100, 110 if any.

The first flat portion 340*a* and the second flat portions 340*b* are suitable for an automated assembly line of the electrical connector. In detail, the first flat portion 340*a* can provide an easy transfer of the lock member 340 by using a vacuum carrier (not shown). The second flat portions 340*b* can be easily pressed by applying a force along the y-direction by using a pressing tool that has a flat pressing surface.

Figure 10:
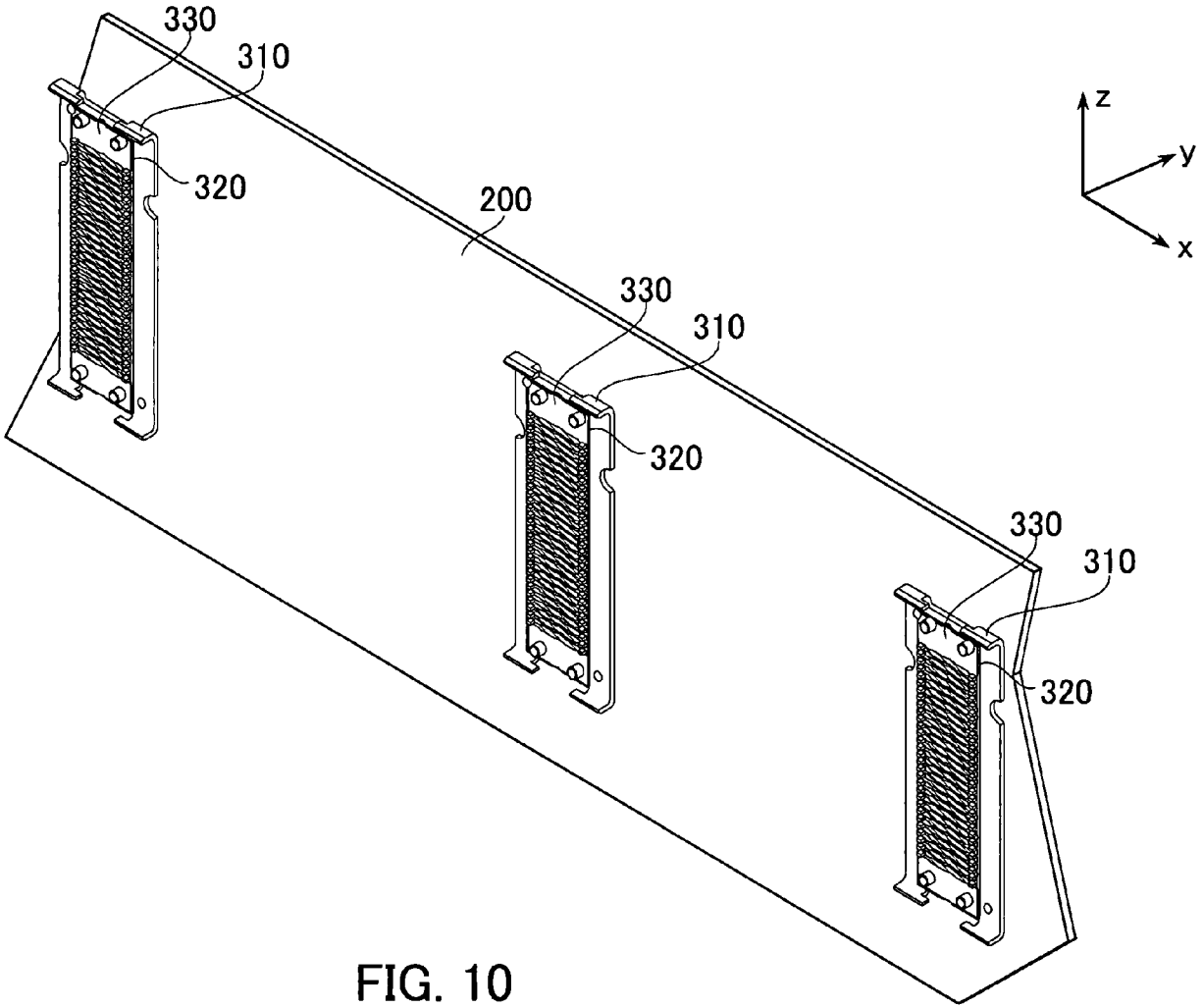
FIG. 10 is a perspective view showing an installation process of the electrical connector of FIG. 1.
Figure 11:
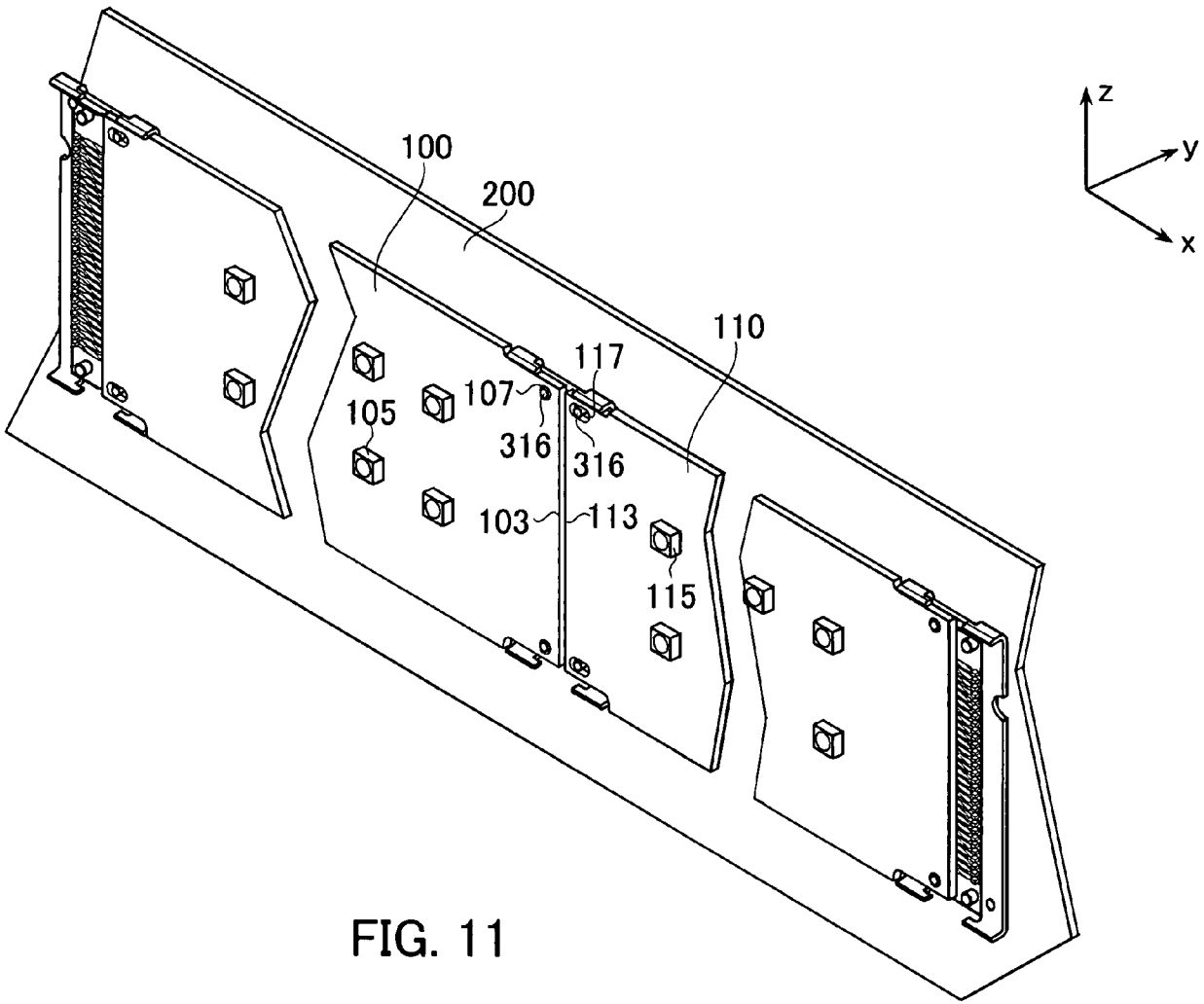
FIG. 11 is a perspective view showing an installation process subsequent to that of FIG. 10.
Figure 12:
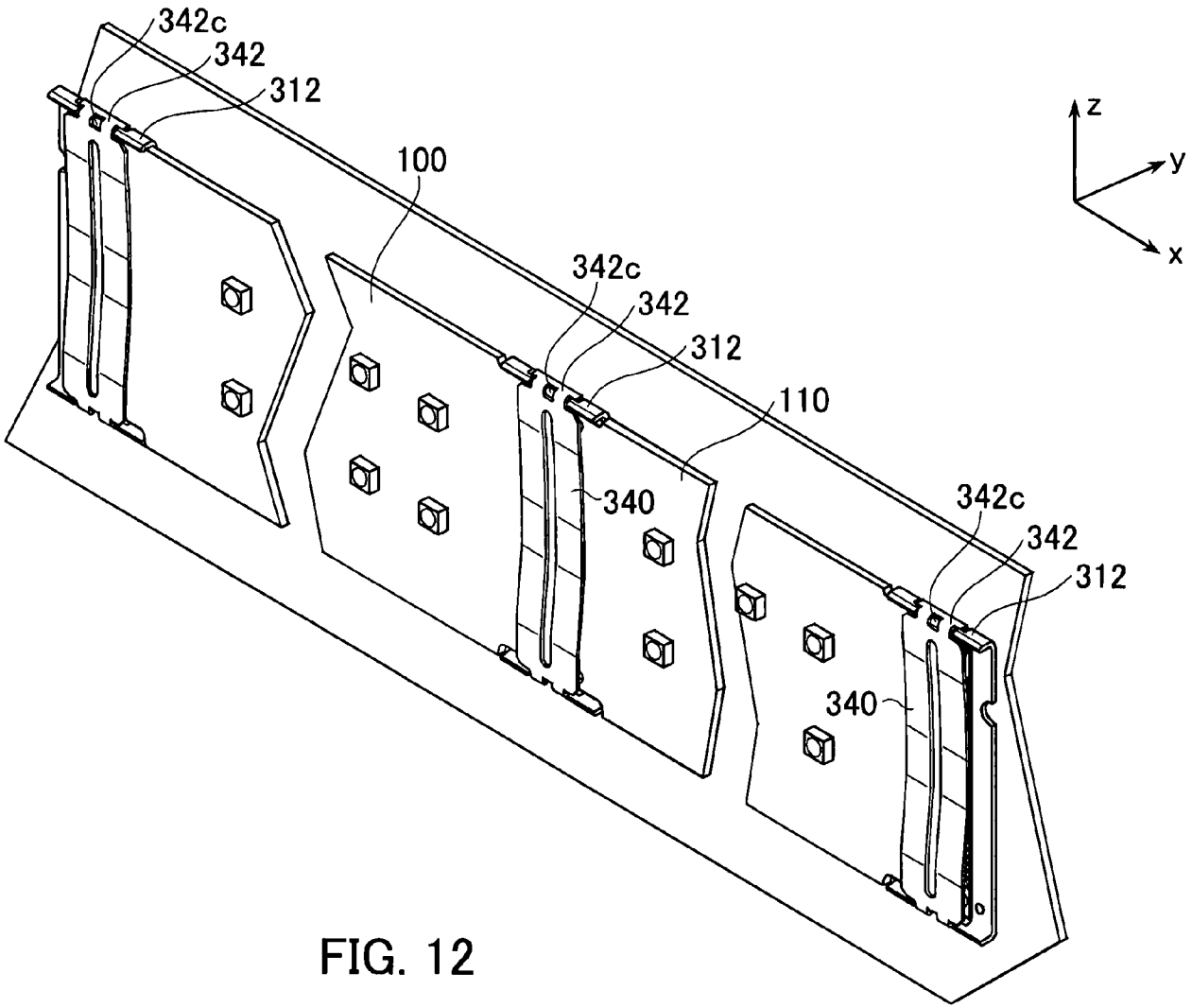
FIG. 12 is a perspective view showing an installation process subsequent to that of FIG. 11.

With reference to FIGS. 10 to 12, the electrical connectors as explained above can be fabricated simultaneously. First, as shown in FIG. 10, the base plates 310 are set on the case 200, and the press members 320 and the electrode sheets 330 are then attached to the respective base plates 310. Next, as shown in FIG. 11, the positioning protrusions 316 are inserted into positioning holes 107, 117 of the circuit boards 100, 110 so that the conductive portion of the circuit boards 100, 110 are in contact with the electrode pattern 334 of the electrode sheet 330. Next, the lock members 340 are transferred on the edges 103, 113 of the circuit boards 100, 110 by using a vacuum carrier. Then, the lock members 340 are applied with pressure simultaneously so that the lock members 340 are locked to the respective base members 310, as shown in FIG. 12.

When the lock member 340 is detached from the base plate 310, a stick-like tool is inserted into the hole 342*c* of the lock member 340 and is then tilted to easily release the engagement of the second portion 342 and the first portion 312.

Figure 13:
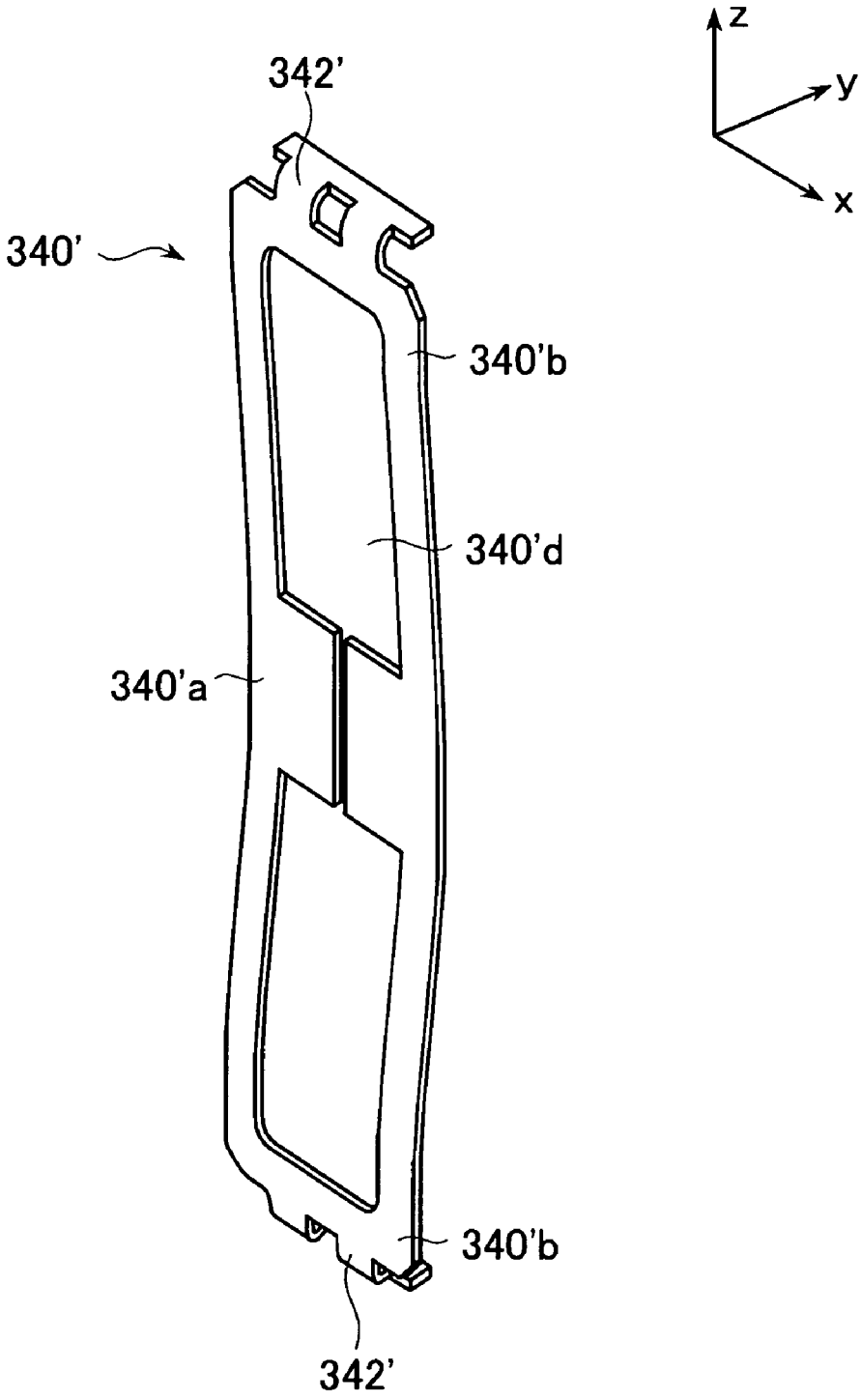
FIG. 13 is a perspective view showing a modification of the lock member of FIG. 1.

The lock member 340 may be modified into a lock member 340', as illustrated in FIG. 13. The illustrated lock member 340' is formed with a slot 340*d*' that is generally wider than the slot 340*d*. The generally wider slot 340'*d* forces the second flat portions 340'*b* to have C-like shapes, respectively. The slot 340'*d* is narrow in the first flat portion 340'*a* so that a transfer of the lock member 340' by a vacuum carrier can be easily applied to this modification, too.

Figure 14:
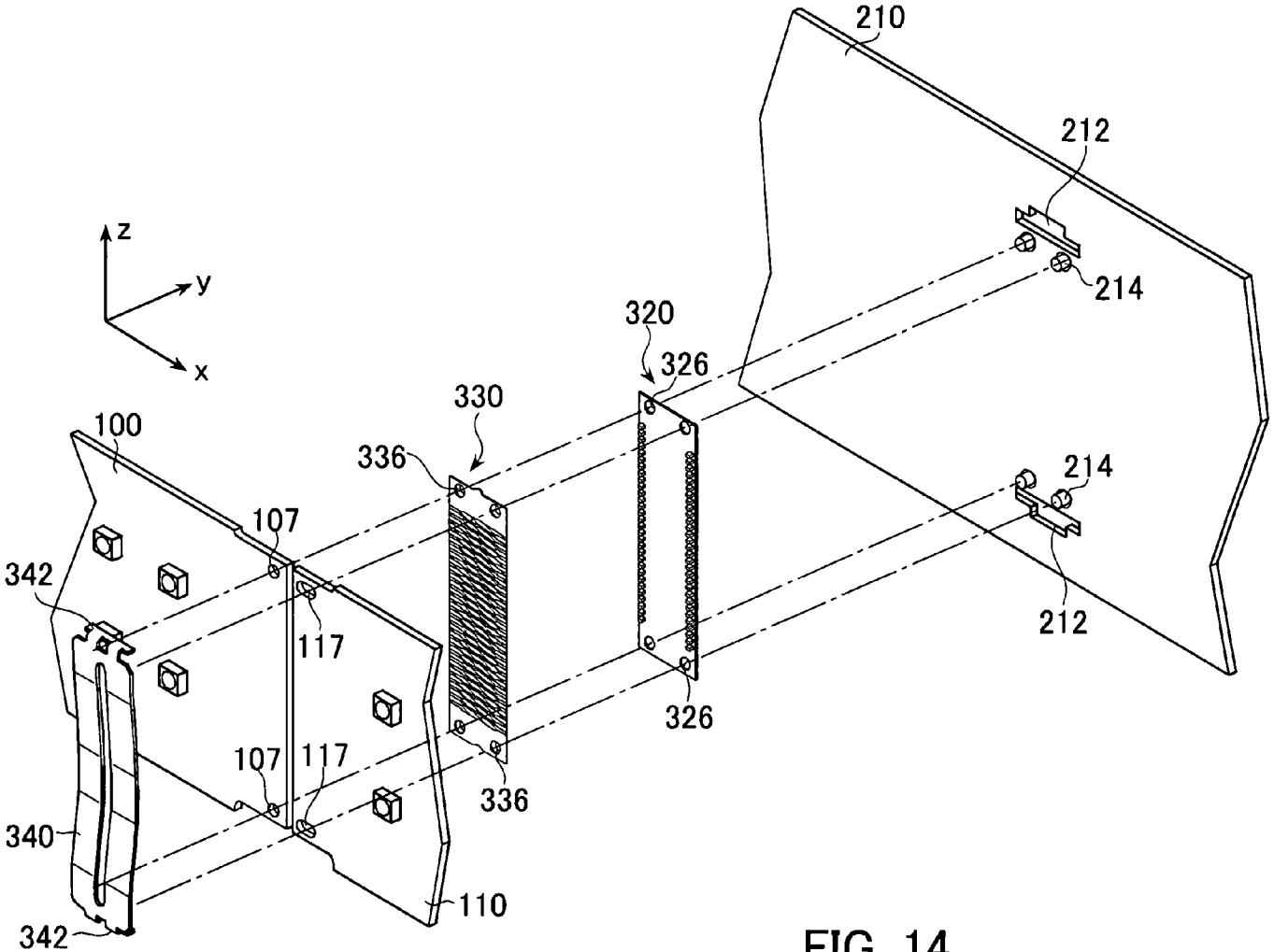
FIG. 14 is a perspective view showing a modification of the electrical connector of FIG. 1, wherein the modification does not have a base plate of FIG. 1.

Instead of the base plate 310, a case or chassis 210 may be used as a supporter for supporting the press member 320; in that case, the base plate 310 may be omitted. The case 210 is formed with engagement holes 212 and positioning protrusions 214. Each of the engagement holes 212 has a reverse T-like shape. A distance between narrower potions of the engagement holes 212 in the z-direction is larger then a distance between wider portions of the engagement holes 212 in the z-direction. As apparent from FIGS. 1 and 14, the engagement holes 212 serve as the first portions 312, respectively. The positioning protrusions 214 are inserted into the positioning holes 326, the positioning holes 336, and the positioning holes 107, 117, respectively. With the engagement holes 212, the second portions 342 of the lock member 340 are engaged so that the modified electrical connector can be fabricated.

Although the above-mentioned connection targets are the circuit boards 100, 110, the present invention is not limited thereto. Sheet-like connection targets such as flexible flat cables can also be connected by an electrical connector according to the present invention.

The present application is based on a Japanese patent application of JP2007-240173 filed before the Japan Patent Office on Sep. 14, 2007, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An electrical connector for electrically connecting conductive portions formed on edges of printed circuit boards, respectively, while the edges face each other, the electrical connector comprising:

an electrode sheet comprising an insulation sheet and an electrode pattern formed on the insulation sheet;

a press member made of elastic material distinct from the electrode sheet, the press member being arranged to press the electrode pattern against the conductive portions of the printed circuit boards when the press member is compressed, so that the conductive portions of the printed circuit boards are connected to each other by the electrode pattern; and a support connection member configured to keep the connection between the conductive portions of the printed circuit boards with the press member;

wherein the support connection member is formed with positioning protrusions and configured to hold the edges of the printed circuit boards and the press member with the electrode sheet sandwiched between the press member and the edges of the printed circuit boards.

2. The electrical connector according to claim 1, wherein the support connection member comprises: a supporter formed with a first engagement portion, the supporter being arranged to support the press member on which the electrode sheet and the edges of the printed circuit boards are placed; and a lock member formed with a second engagement portion which is engaged with the first engagement portion while the lock member is arranged on the edges of the printed circuit boards.

3. The electrical connector according to claim 2, wherein:

the electrode sheet is formed with positioning holes which correspond to the positioning protrusions, respectively, and are arranged so that the electrode sheet sags when the positioning protrusions are inserted into the positioning holes, respectively.

4. The electrical connector according to claim 2, wherein:

the second engagement portion comprises two second portions formed at opposite ends of the lock member in a first direction;

the lock member has a specific shape that, when the second engagement portion is not engaged with the first engagement portion, has a M-like shape in a cross-section on a plane defined by the first direction and a second direction perpendicular to the first direction; and the first engagement portion comprises two first portions with which the second portions are engaged.

5. The electrical connector according to claim 4, wherein:

each of the first portions has a C-like shape and has a receiving portion at which the C-like shape opens, and each of the second portions has a T-like shape and comprises a neck portion and a head portion, the neck portion being smaller than the receiving portion in a third direction perpendicular to the first and the second directions, the head portion being larger than the receiving portion in the third direction.

6. The electrical connector according to claim 4, wherein the lock member is provided with a first flat portion and second flat portions, the first flat portion being positioned at a center of the lock member in the first direction, the second flat portions being positioned inside the second portions, respectively, in the first direction.

7. The electrical connector according to claim 1, wherein:

the electrode patterns comprises a plurality of conductive traces; and the press member comprises a main sheet portion and a plurality of protrusions protruding from the main sheet portion, the protrusions corresponding to the conductive traces, respectively.

* * * * *